United States Patent [19]

Holmes et al.

[11] 4,055,429

[45] Oct. 25, 1977

[54] INHIBITOR BARRIER LAYERS FOR PHOTOGRAPHIC MATERIALS

[75] Inventors: Edmund Thompson Holmes; Gerald Allan Campbell, both of Rochester, N.Y.

[73] Assignee: Eastman Kodak Company, Rochester, N.Y.

[21] Appl. No.: 631,800

[22] Filed: Nov. 13, 1975

[51] Int. Cl.[2] ..... G03C 1/76; G03C 1/48; G03C 1/84

[52] U.S. Cl. ..... 96/74; 96/76 R; 427/407 R

[58] Field of Search ..... 96/74, 76 R; 427/407 R

[56] References Cited

U.S. PATENT DOCUMENTS

| | | | |
|---|---|---|---|
| 3,161,506 | 12/1964 | Becker | 96/76 |
| 3,706,557 | 12/1972 | Arond | 96/29 |
| 3,813,244 | 5/1974 | Villard | 96/74 |
| 3,898,088 | 8/1975 | Cohen et al. | 96/74 |
| 3,958,995 | 5/1976 | Campbell et al. | 96/77 |

FOREIGN PATENT DOCUMENTS

| | | |
|---|---|---|
| 2,448,232 | 10/1975 | Germany |

*Primary Examiner*—David Klein
*Assistant Examiner*—Louis Falasco
*Attorney, Agent, or Firm*—Arthur H. Rosenstein

[57] ABSTRACT

A photographic element comprises a support, a silver halide emulsion layer and a layer containing a polymeric scavenger for development inhibitors. The movement of development inhibitor anions from layer to layer in a film, out of the film, or into the film from processing solutions, can be controlled by the presence of the polymeric scavenger layer.

19 Claims, No Drawings

INHIBITOR BARRIER LAYERS FOR PHOTOGRAPHIC MATERIALS

The present invention relates to novel photographic elements containing polymeric scavengers for development inhibitors and to a process of forming visible images using said photographic elements.

It is well known in the photographic art to employ development inhibitor releasing compounds in photographic elements for the purpose of selectively controlling the development of silver halide emulsion layers. The use of these compounds can result in desirable improvements in sensitometry and image structure by reducing contrast and introducing intralayer and interlayer development effects. The use of development inhibitor releasing couplers which react with the oxidation product of a color developing agent to release a development inhibiting fragment, for example, is described in U.S. Pat. No. 3,148,062. U.S. Pat. No. 3,379,529 describes the use of inhibitor releasing developers which release a development inhibiting fragment as a function of silver halide development. Other development inhibitor releasing agents which are capable of imagewise releasing development inhibiting anion are disclosed in U.S. Pat. Nos. 3,819,379; 3,297,445; 3,227,554; 3,733,201; 3,617,291 and 3,632,345. The release of these inhibitors on development can reduce the granularity and enhance the sharpness of the image.

The migration of a development inhibiting fragment from the emulsion layer wherein it is released from its carrier, however, can detrimentally affect the processing of other layers in the same element or in subsequently processed photographic elements. For example, migration of the released inhibitors to adjacent layers can adversely affect sensitometry in the layers wherein their presence is not desired. This is especially critical in certain multicolor photographic elements where the wandering of inhibitor anions from one layer to another can cause unwanted interimage effects. Another serious problem involving the wandering of inhibitor anions is that they can diffuse into the developing solution from the photographic element and undesirably "season" the developing solution. Thus, inhibitor anions are built up in the developer solution, and subsequent film to be processed in the developer solution is affected in a nonimagewise fashion.

The use of development inhibitor scavenger layers to prevent migration of development inhibitor fragments is described, for example, in British Pat. No. 1,201,110, issued Aug. 5, 1970. In this patent an intermediate layer positioned between two emulsion layers is described containing silver halide grains of low photosensitivity. The migrating inhibitor development fragments are captured and the other emulsion layers are protected from the fragments.

The use of Lippman emulsions as barrier layers either above, between or under image forming emulsion layers to inhibit development inhibitors from migrating either between layers or from the element to the developer solution is known in the art, as described in U.S. Pat. No. 3,737,317, and U.S. Pat. No. 3,642,485. However, the use of fine grain silver halide barrier layers has been found to sometimes alter the sensitometry of the image forming layers adjacent thereto. This alteration is especially undesirable when the Lippman emulsion is used as an interlayer between two image-forming layers, particularly in fine grain systems.

Further, may inhibitors such as dichlorobenzotriazole are more mobile and less reactive to silver halide than common thiol inhibitors, for example 1-phenyl-5-mercaptotetrazole, therefore requiring larger amounts of development inhibitor release agent to be used to release these inhibitors on development and, consequently, higher amounts of scavenger to protect the system. Thick silver halide emulsion barrier layers must be used for these inhibitors. Other inhibitor absorbing colloid layers are described in German OLS 2,448,237.

It is an object of this invention to provide inhibitor barrier layers comprising development inhibitor scavengers.

It is another object of this invention to provide photographic silver halide elements containing inhibitor barrier layers which do not appreciably alter the sensitometry of adjacent emulsion layers and which can be used in reasonable amounts to achieve good results.

It is a further object of this invention to provide a process for forming visible photographic images comprising exposing and developing an element containing a layer or layers comprising development inhibitor scavengers.

These objects are accomplished by using a development inhibitor scavenger consisting of a crosslinked polymer represented by the formula:

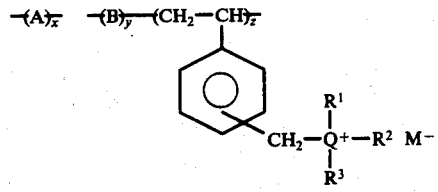

wherein

A is a polymerized monomer containing at least two ethylenically unsaturated groups;

B is a polymerized copolymerizable, $\alpha,\beta$-ethylenically unsaturated monomer;

Q is N or P;

$R^1$, $R^2$ and $R^3$ are independently selected from the group consisting of carbocyclic, alkyl, aryl and aralkyl, and wherein $R^1$, $R^2$ and $R^3$ together can form the atoms necessary to complete a heterocyclic ring with Q, such as pyridinium.

$M^-$ *is an anion;*

$x$ is from about 0.25 to about 5 mole percent;

$y$ is from about 0 to about 90 mole percent; and $z$ is from about 10 to about 99 mole percent. The scavenger is a water dispersible polymer in particulate form.

Preferred polymers according to this invention comprise units having the formula above wherein A is a repeating unit of an addition polymerizable monomer containing at least 2 ethylenically unsaturated groups, such as vinyl groups generally having the structure

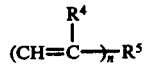

wherein n is an integer greater than 1 and preferably 2 or 3; $R^4$ is selected from hydrogen and methyl and $R^5$ is a linking group comprising 1 or more condensation linkages such as an amide, a sulfonamide, an ester such as sulfonic acid ester, and the like, or a condensation linkage and an organic nucleus, incuding an alkylene group, such as methylene, ethylene, trimethylene; an arylene group, such as phenylene and others such as phenylenedi(oxycarbonyl), 4,4'-isopropylidene bis(-phenyleneoxycarbonyl), methylenedi(oxycarbonyl), ethylenedi(carbonyl), 1,2,3-propanetriyltris(oxycarbonyl), cyclohexylenebis(methyleneoxycarbonyl), methyleneoxymethylenedi(carbonyloxy), ethylenebis(oxyethyleneoxycarbonyl), ethylidyne trioxycarbonyl, and the like. The monomer (A) used must be stable in the presence of strong alkali and must not be highly reactive so that hydrolysis does not occur during copolymerization.

Suitable examples of monomers from which the repeating units (A) are formed are divinylbenzene, allyl acrylate, allyl methacrylate, N-allylmethacrylate, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene diacrylate, ethylene dimethacrylate, ethylidene diacrylate, ethylidene dimethacrylate, 1,6-diacrylamidohexane, 1,6-hexamethylene diacrylate, 1,6-hexamethylene dimethacrylate, N,N'-methylenebisacrylamide, 2,2-dimethyl-1,3-trimethylene dimethacrylate phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, triethylene glycol dimethacrylate, ethylidyne trimethacrylate, propylidyne triacrylate, vinyl allyloxyacetate, vinyl methacrylate, 1-vinyloxy-2-allyloxyethane, and the like. Divinylbenzene is a particularly preferred monomer.

B is a unit of a copolymerizable $\alpha,\beta$-ethylenically unsaturated monomer (including two, three or more repeating units) such as ethylene, propylene, 1-butene, isobutene, 2-methylpentene, 2-methylbutene, 1,1,4,4-tetramethylbutadiene, styrene, alpha-methylstyrene; monoethylenically unsaturated esters of aliphatic acids such as vinyl acetate, isopropenyl acetate, allyl acetate, etc.; esters of ethylenically unsaturated mono- or dicarboxylic acids such as methyl methacrylate, ethyl acrylate, diethyl methylenemalonate, etc.; monoethylenically unsaturated compounds such as acrylonitrile, allyl cyanide, and dienes such as butadiene and isoprene. A preferred class of ethylenically unsaturated monomers which may be used to form the ethenic polymers of this invention includes the lower 1-alkenes having from 1 to 6 carbon atoms, styrene, and tetramethylbutadiene and methyl methacrylate.

$R^1$, $R^2$ and $R^3$ are each independently selected from the group consisting of carbocyclic groups including aryl, aralkyl, and cycloalkyl such as benzyl, phenyl, p-methylbenzyl, cyclohexyl, cyclopentyl and the like, and alkyl all preferably containing from 1 to 20 carbon atoms, such as methyl, ethyl, propyl, isobutyl, pentyl, hexyl, heptyl, decyl and the like. In the preferred embodiment $R^1$ and $R^2$ are methyl and $R^3$ is benzyl.

$M^-$ is an anion, i.e., a negative salt forming an anionic radical or atom such as a halide (e.g., bromide, chloride), sulfate, alkyl sulfate, alkane or arene sulfonate (for example, a p-toluenesulfonate), acetate, phosphate, dialkyl phosphate or similar anionic moiety.

Q is N or P and $x$ is from about 0.25 to about 5 mole percent and preferably from about 1.0 to 5.0 mole percent; y is from about 0 to about 90 mole percent and preferably from about 0 to 45 mole percent and $z$ is from about 10 to about 99 mole percent, preferably from about 40 to 99 mole percent.

The polymeric materials according to this invention can be prepared by emulsion polymerizing a vinylbenzyl halide with a poly unsaturated monomer A as described above and an $\alpha,\beta$-ethylenically unsaturated monomer B as described above, generally in the presence of an anionic surfactant such as sodium lauryl sulfate,

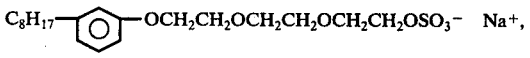

the sodium salt of a sulfated condensate of an alkylphenol and ethylene oxide (Alipal from General Dyestuff Corp.), and the like and a redox free radical initiator such as potassium persulfate-sodium bisulfite, potassium persulfate-$Fe^{+2}$, $H_2O_2$ — $Fe^{+2}$ and the like. This process is described, for example, in U.S. Pat. No. 3,072,588.

The above polymeric vinylbenzyl halide latex can be reacted with a tertiary amine or tertiary phosphine having the structure:

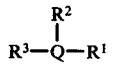

wherein $R^1$, $R^2$, $R^3$ and Q are as described above, generally at temperatures of from about −20° C to about 150° C. This produces a polymeric microgel latex which has a particulate character.

An alternate method of preparing the polymer is to emulsion polymerize a N-vinylbenzyl-N,N-disubstituted amine monomer with monomers A and B as described above in the presence of an anionic surfactant and a redox free-radical initiator. The resulting polymer tertiary amine latex is reacted with an alkylating agent having the structure $R^3$-M wherein $R^3$ is as described above and M is a group which can be displaced to yield the anion $M^-$, preferably $M^-$ is a halide such as chloride or an alkyl or aryl sulfonate group. This reaction can take place at temperatures from about −20° C to about 150° C.

In formulating the polymer by the methods described above, hydrolysis of the reactive vinylbenzyl halide residues with the liberation of HCl can produce some recurring units of the structure

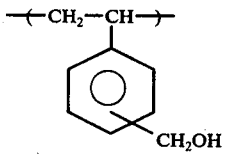

These recurring units are generally present only up to about 5 mole percent of the polymer.

The water-dispersible particulate polymers herein generally have a particle size range of from about 0.041$\mu$ to about 0.15$\mu$. In the preferred embodiment, a particle size range of from 0.06$\mu$ to 0.08$\mu$ is used.

The term "water-dispersible polymers" as used throughout the specification and claims describes polymers which appear as a clear or only slightly cloudly solution on visual inspection but which can be seen to be in particulate dispersion form when examined under an electron microscope.

The polymers are prepared quite easily as the entire preparation can take place in one pot. There is no necessity to use large amounts of solvents. The resulting polymer typically is not completely quaternized. Generally, the mole percent quaternization is from about 80 to about 100 percent.

Some polymers which illustrate the scavengers according to this invention contain the following units:

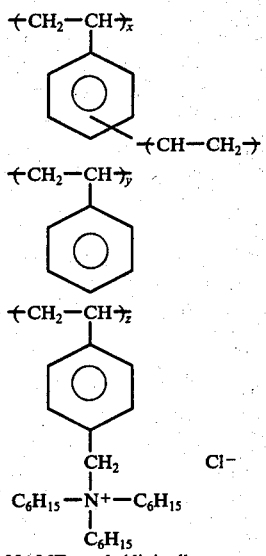

NAME - poly(divinylbenzene-co-styrene-co-trihexylvinylbenzylammonium chloride)

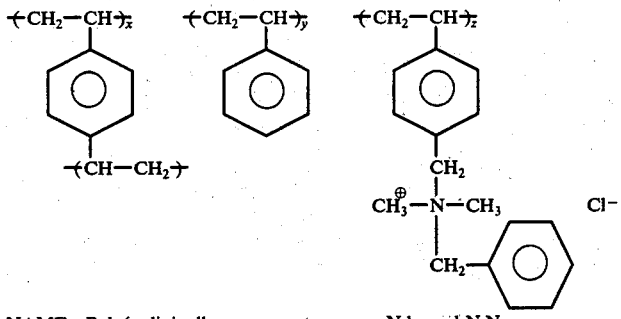

NAME - Poly(p-divinylbenzene-co-styrene-co-N-benzyl-N,N-dimethyl-N-vinylbenzylammonium chloride)

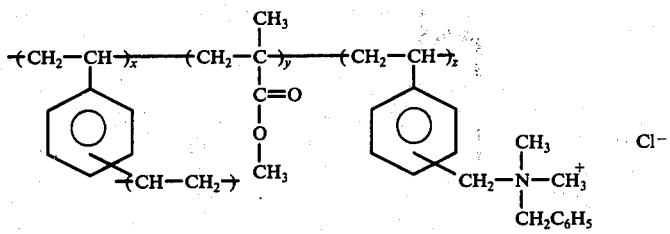

NAME - Poly(divinylbenzene-co-methyl methacrylate-co-N,N-dimethyl-N,N-benzyl-N-vinylbenzylammonium chloride)

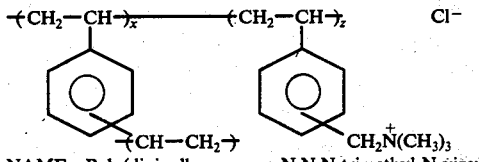

NAME - Poly(divinylbenzene-co-N,N,N-trimethyl-N-vinylbenzylammonium chloride)

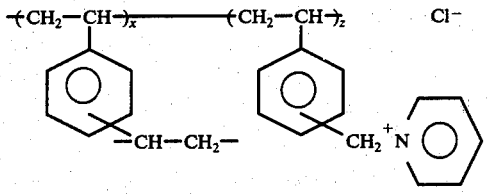

-continued

NAME - Poly(divinylbenzene-co-N-vinylbenzyl-Pyridinium chloride)

The polymers are described in copending U.S. application Ser. No. 525,248, filed Nov. 19, 1974 by Campbell et al now U.S. Pat. No. 3,958,995 as being useful as an acid dye mordant in a photographic element comprising an acid dye. The presence of an acid dye in the photographic element employed in the practice of the instant invention, however, would render the process of scavenging development inhibitors relatively ineffective since the acid dye would compete for the scavenging sites of the polymeric layer.

The scavenging layer can be prepared by merely dispersing the polymer in an aqueous emulsion containing a hydrophilic binder such as gelatin, colloidal albumin, polysaccharide, cellulose derivatives, synthetic resins such as polyvinyl compounds including polyvinyl alcohol derivates, acrylamide polymers and the like. Generally, a polymer to binder ratio from about 1:10 to about 1:1 is preferred. The carrier need not be entirely comprised of water. Up to 10% by weight of water miscible organic solvents, such as alcohols, including methanol, ethanol, isopropanol, 2-methoxyethanol, and the like can be added to the aqueous solution.

The scavenging layer is useful in the preparation of photographic elements comprising a support and at least one silver halide-containing layer. The support can comprise any photographic support material such as paper, baryta coated paper, resin coated paper, pigment coated polymeric film, poly(ethylene terephthalate), cellulose acetate, glass, grained aluminum, polycarbonates and the like such as described in *Product Licensing Index,* Vol. 92, Dec. 1971, publication 9232, pages 107–110. The support can consist of any of the above materials or like materials coated with various layers such as timing layers, overcoat layers, acid layers and the like.

The scavenging layer can be positioned anywhere in the element. It can be an overcoat or an interlayer between image forming layers or it can be included within an image forming layer. If desired, more than one scavenging layer can be used.

The scavenging layer is useful as an overcoat to prevent inhibitors from escaping from the film or element to the developing solution and, if the developing solution is already "seasoned", the overcoat would prevent the inhibitor in the developing solution from diffusing into the element. The scavenging layer can also be used between layers in the element to prevent the inhibitor from diffusing from one layer to another such as from a cyan layer to a magenta layer.

Development inhibitor releasing materials, if present, can be used in either the pohtographic silver halide emulsion layer or layers contiguous thereto or both and can be present in an overcoat if desired. In some embodiments, however, the development inhibitor releasing material is present in the photographic emulsion layer of the element. The element can be exposed to an original or negative and developed by merely treating the exposed emulsion layer with an alkaline developer bath.

The developers can be applied to an exposed photographic element in any number of known ways, such as by dipping, spraying, or other suitable surface applications. The photographic element can then be stabilized by conventional fixation or stabilization, such as by sodium thiosulfate.

The concentration of development inhibiting releasing materials that can be used herein will vary depending upon the particular chemical compound involved and the location of the compound within the photographic element. That is, if the inhibitor releasing agent is incorporated within the silver halide emulsions undergoing development, it may be desirable to use a somewhat different concentration than would be used if the agent were incorporated in a layer contiguous to the photographic silver halide emulsion. A useful concentration of agent for incorporation in the emulsion is from about 0.01 to 4.0 moles per mole of silver halide.

Photographic silver halide emulsions useful in our invention comprise any of the ordinarily employed silver halide developing-out emulsions, such as silver-chloride, -chlorobromide, -chloroiodide, -chlorobromoiodide, -bromide and -bromoiodide emulsions.

Any of the conventionally employed water-permeable hydrophilic colloids can be employed in the silver halide emulsions, or in a layer contiguous thereto. Typical water-permeable hydrophilic colloids include gelatin, albumin, polyvinyl alcohols, agar agar, sodium alginate, hydrolyzed cellulose esters, hydrophilic polyvinyl copolymers, etc.

Photographic silver halide emulsions useful in our invention can also contain such addenda as chemical sensitizers, development modifiers, antifoggants, and the like. Examples of these can be found in *Product Licensing Index,* Publication 9232, Vol. 92, Dec. 1971, pp. 107–110.

The emulsions may also be chemically sensitized with reducing agents such as stannous salts (Carrol U.S. Pat. No. 2,487,850), polyamines such as diethylene triamine (Lowe and Jones, U.S. Pat. No. 2,518,698), polyamines such as spermine, (Lowe and Allen U.S. Pat. No. 2,521,925), or bis-($\beta$-aminoethyl) sulfide and its water-soluble salts (Lowe and Jones U.S. Pat. No. 2,521,925), sulfur sensitizers (e.g., allyl thiocarbamate, thiourea, allyl isothiocyanate, cystine, etc.), various gold compounds (e.g., potassium chloroaurate, auric trichloride, etc. See U.S. Pat. Nos. 2,540,085; 2,597,856; and 2,597,915, etc.).

The emulsions of the invention can also contain speed-increasing compounds of the quaternary ammonium type as described in U.S. Pat. Nos. 2,271,623, issued Feb. 3, 1942; 2,288,226, issued June 30, 1942; 2,334,864, issued Nov. 23, 1943; or the thiopolymers as described in Graham et al, U.S. application Ser. No. 779,839, filed Dec. 12, 1958, now Pat. No. 3,046,129; and Dann et al, U.S. application Ser. No. 779,874, now U.S. Pat. No. 3,046,134, filed Dec. 12, 1958.

The emulsions may also be stabilized with mercury compounds and the like such as described in Allen, Byers and Murray U.S. application Ser. No. 319,611; Carroll and Murray U.S. application Ser. No. 319,612; and Leubner and Murray U.S. application Ser. No. 319,613, all filed November 8, 1952, now U.S. Pat. Nos. 2,728,663; 2,728,664 and 2,728,665, respectively, granted Dec. 17, 1955.

The use of scavenging layers as described herein is particularly useful with multicolor photographic elements employing development inhibitors. Thus, elements having on a support at least (1) a red-sensitive coupler-containing silver halide emulsion layer, (2) a green-sensitive coupler-containing emulsion layer, (3) a blue-sensitive coupler-containing emulsion layer and (4) a layer such as an intermediate layer containing the scavenging polymer to prevent migration of the inhibitor used are desirable. The intermediate layer can be between any or all of the color-forming layers.

In the intermediate layer the polymer substantially reduces the migration of the inhibitor anions into emulsion layers where they are not desired.

In another embodiment the present invention can comprise a multi-layer photographic light-sensitive element having an emulsion layer containing a compound which releases iodide ions by its reaction with the oxidation product of a developing agent. Scavenger layers adjacent to these layers can capture a substantial portion of these inhibitors before they interact with the silver halide emulsions in neighboring layers.

Development inhibitors and development inhibitor precursors can be introduced into photographic materials and processes by several methods. For example, iodide and bromide ions can be released as a result of the development of silver halide emulsions containing said ions. Silver haloiodide emulsions are highly desirable in photographic materials and processes because of their increased photographic speed and spectral response and the desirable interimage effects obtained as a result of the presence of iodide in the silver halide grain.

Development-inhibitor-releasing (DIR) compounds are also incorporated in certain photographic elements for the improved sensitometric results they can provide. Examples of such compounds include couplers and reducing agents.

Development-inhibitor-releasing couplers which release said inhibitors upon reaction with oxidized color developer are described in Whitmore et al U.S. Pat. No. 3,148,062; Barr et al U.S. Pat. Nos. 3,227,554 and 3,733,201; and Sawdey U.S. Pat. No. 3,617,291. These references disclose photographic dye-forming couplers which release inhibitors such as certain anionic tetrazoles, triazoles, oxazoles, thiazoles and the like, all of which can be effectively scavenged by the inhibitor barrier layers of this invention. Iodide ions can also be released from couplers to act as development inhibitors such as disclosed, for example, in German Pat. No. 1,943,134 and U.S. Pat. No. 3,006,759.

Development-inhibitor-releasing reducing agents are compounds which are capable of imagewise releasing inhibitors when they become oxidized during the development of exposed silver halide. Typical examples include iodide-releasing hydroquinones, such as described in Deunnebier et al U.S. Pat. No. 3,297,445, and mercaptan-releasing hydroquinones such as described in Porter et al U.S. Pat. No. 3,379,529 and Barr U.S. Pat. No. 3,364,022.

A further class of compounds capable of releasing development inhibitors includes phenacyl DIR compounds, which release a development inhibitor, e.g. a mercapto-tetrazole, upon reaction with oxidized color developing agents.

Although many desirable sensitometric effects can be obtained by the presence of said development inhibitors, undesirable effects may also be encountered. The problems created by the presence of development inhibitors, as well as problems presented by the use of Lippmann emulsion barrier layers, are discussed in Nicholas et al U.S. Pat. No. 3,737,317.

The barrier layers according to the present invention are effective in scavenging anions released from within a multi-layer, color negative or reversal material by developing inhibitor releasing compounds incorporated therein. Further, the scavenging layers can scavenge photographically active iodide ions which are released from iodide containing silver halide emulsions during development.

The following examples further illustrate various embodiments of the invention.

EXAMPLES 1-23

A series of photographic elements containing various scavenger layers were prepared having the following structure (coverages in mg/0.093m² in parentheses).

| | |
|---|---|
| layer 4 | gelatin (200) + scavenger |
| layer 3 | gelatin (45) |
| layer 2 | fast yellow layer |
| layer 1 | slow yellow layer |
| | support |

The slow yellow layer consists of AgBr I emulsion (44), gelatin (145), and yellow dye forming coupler

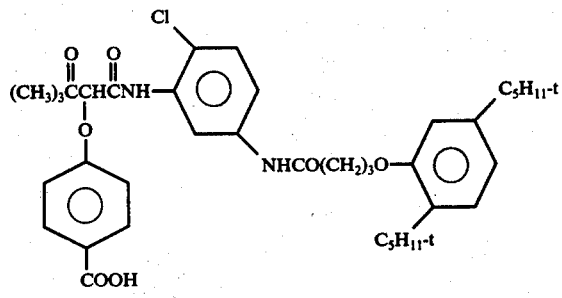

(97.3) dissolved in di-n-butyl phthalate (24) and diethyllauramide (24).

The fast yellow layer consists of a coarser grain AgBrI emulsion (107), gelatin (98.4) and yellow dye-forming coupler as described above (9.5) dissolved in di-n-butyl phthalate (2.4) and deithyllauramide (2.4).

Various scavenger materials at various levels were added to the overcoat.

Samples of each element were exposed to a graduated density test object and developed for 3 minutes at 41° C in a color-developing solution containing the following components in 1 liter of water.

| | | |
|---|---|---|
| sodium tripolyphosphate | 2.0 | ml |
| sodium sulfite | 2.0 | g. |
| 3,5-dinitrobenzoic acid | 0.22 | g. |
| sodium bromide | 1.2 | g. |
| sodium carbonate monohydrate | 30 | g. |
| sodium bicarbonate | 2.7 | g. |
| 4-amino-3-methyl-N-ethyl-N-beta-(methanesulfonamido)ethylaniline | 4.0 | g. |
| pH of 10.20 at 27° C | | |

Various development inhibitors are added at various molar concentrations to the developer solution. After development the samples were bleached, fixed and washed to yield negative yellow dye images.

Sensitometric curves were obtained for each processed element and the amount of inhibition was recorded in terms of density loss and speed loss measured at specific points on the characteristic curves. The density loss is the decrease in density units measured at an equal value of exposure on all curves (point on the curve of the element containing no scavenger layer representing an initial density of 1.0). The recorded speed loss of each sample relative to the element containing no scavenger layer was measured in log E units at a point on each curve which is 0.2 density unit above $D_{min}$ as compared to the element containing no inhibitor or scavenger. The following Table I shows the results obtained.

TABLE I

| Example | Inhibitor Scavenger (mg/0.093m²) | Inhibitor | Molar Concentration of Inhibitor $6.4 \times 10^{-5}$ Density Loss | $6.4 \times 10^{-5}$ Speed Loss | $3.2 \times 10^{-5}$ Density Loss | $3.2 \times 10^{-5}$ Speed Loss | $1.8 \times 10^{-5}$ Density Loss | $1.8 \times 10^{-5}$ Speed Loss | $0.8 \times 10^{-5}$ Density Loss | $0.8 \times 10^{-5}$ Speed Loss |
|---|---|---|---|---|---|---|---|---|---|---|
| Control | none | 5,6-dichloro-benzotriazole | 0.90 | 1.50 | 0.68 | 0.85 | 0.34 | 0.35 | 0.12 | 0.15 |
| 1 | A* (100) | " | 0.16 | 0.15 | 0.04 | 0.05 | 0.02 | 0.00 | 0.02 | 0.00 |
| 2 | B* (73) | " | 0.40 | 0.45 | 0.16 | 0.17 | 0.12 | 0.13 | 0.05 | 0.10 |
| 3 | C* (63) | " | 0.36 | 0.41 | 0.14 | 0.16 | 0.06 | 0.06 | 0.01 | 0.02 |
| 4 | D* (53) | " | 0.34 | 0.38 | 0.16 | 0.20 | 0.07 | 0.08 | 0.04 | 0.03 |
| 5 | E* (52) | " | 0.35 | 0.37 | 0.15 | 0.17 | 0.08 | 0.07 | 0.03 | 0.03 |
| 6 | F* (100) | " | 0.16 | 0.18 | 0.07 | 0.07 | 0.07 | 0.07 | 0.03 | 0.03 |
| 7 | G* (100) | " | 0.23 | 0.26 | 0.12 | 0.14 | 0.08 | 0.10 | 0.05 | 0.07 |
| 8 | H* (82) | " | 0.43 | 0.48 | 0.23 | 0.23 | 0.11 | 0.10 | 0.08 | 0.07 |
| 9 | I* (109) | " | 0.16 | 0.14 | 0.10 | 0.13 | 0.09 | 0.11 | 0.04 | 0.05 |
| 10 | A (50) | " | 0.44 | 0.51 | 0.21 | 0.25 | 0.10 | 0.08 | 0.06 | 0.04 |
| 11 | J* (50) | " | 0.30 | 0.36 | 0.12 | 0.11 | 0.06 | 0.07 | 0.02 | 0.00 |
| 12 | K* (50) | " | 0.20 | 0.16 | 0.08 | 0.09 | 0.06 | 0.06 | 0.03 | 0.00 |
| Control A | AgBr Lippmann emulsion (50) | " | 0.57 | 0.75 | 0.27 | 0.27 | 0.11 | 0.09 | — | — |
| Control B | AgBr Lippmann emulsion (115) | " | 0.32 | 0.38 | 0.09 | 0.10 | 0.03 | 0.05 | — | — |
| Control C | none | 4,6,7-tri-bromo-5-chlorobenzo-triazole | 0.96 | >3.00 | 0.93 | 1.90 | 0.88 | 1.36 | 0.63 | 0.71 |
| 13 | A (100) | " | 0.04 | 0.04 | 0.00 | 0.00 | 0.00 | 0.00 | 0.00 | 0.00 |
| 14 | D (53) | " | 0.06 | 0.04 | 0.03 | 0.00 | 0.00 | 0.00 | 0.00 | 0.00 |
| Control D | AgBr Lippmann emulsion (50) | " | 0.85 | 1.70 | 0.66 | 0.97 | 0.30 | 0.36 | — | — |
| Control E | AgBr Lippmann emulsion (115) | " | 0.67 | 1.01 | 0.29 | 0.33 | 0.05 | 0.03 | — | — |
| Control F | none | 1-phenyl-5-mercaptotetra-zole | 0.95 | >3.00 | 0.95 | >3.00 | 0.92 | 1.95 | 0.64 | 0.82 |
| 15 | A (100) | " | 0.83 | 1.32 | 0.49 | 0.63 | 0.22 | 0.28 | 0.12 | 0.14 |
| 16 | H (82) | " | 0.93 | 2.63 | 0.89 | 1.54 | 0.74 | 1.02 | 0.28 | 0.39 |
| 17 | L* (109) | " | 0.78 | 1.08 | 0.48 | 0.61 | 0.21 | 0.26 | 0.09 | 0.10 |
| 18 | F (100) | " | 0.85 | 1.28 | 0.54 | 0.65 | 0.23 | 0.27 | 0.15 | 0.14 |
| 19 | G (100) | " | 0.92 | 1.91 | 0.76 | 1.02 | 0.36 | 0.45 | 0.19 | 0.23 |
| Control G | AgBr Lippmann emulsion (50) | " | 0.54 | 0.78 | 0.14 | 0.20 | 0.01 | 0.02 | — | — |
| Control H | AgBr Lippmann emulsion (115) | 5-phenyl-1-mercapto-tetrazole | 0.17 | 0.19 | 0.02 | 0.03 | 0.00 | 0.00 | — | — |
| Control I | none | iodide ion | 0.91 | 1.72 | 0.67 | 0.79 | 0.36 | 0.37 | 0.18 | 0.20 |
| 20 | I (109) | " | 0.83 | 1.28 | 0.50 | 0.53 | 0.18 | 0.20 | 0.07 | 0.07 |
| 21 | J (50) | " | 0.87 | 1.41 | 0.52 | 0.56 | 0.20 | 0.20 | 0.12 | 0.16 |
| 22 | K (50) | " | o.85 | 1.30 | 0.65 | 0.78 | 0.19 | 0.18 | 0.08 | 0.11 |
| 23 | A (50) | " | — | — | 0.60 | 0.73 | 0.26 | 0.25 | 0.10 | 0.10 |

TABLE I-continued
| Example | Inhibitor Scavenger (mg/0.093m²) | Inhibitor | Molar Concentration of Inhibitor $6.4 \times 10^{-5}$ Density Loss | Speed Loss | $3.2 \times 10^{-5}$ Density Loss | Speed Loss | $1.8 \times 10^{-5}$ Density Loss | Speed Loss | $0.8 \times 10^{-5}$ Density Loss | Speed Loss |
|---|---|---|---|---|---|---|---|---|---|---|
| *A = 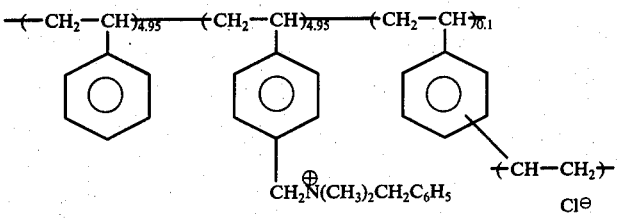 | | | | | | | | | | |
| *B = 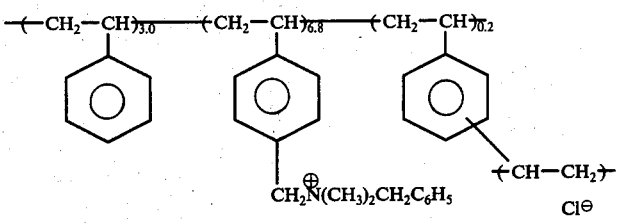 | | | | | | | | | | |
| *C = 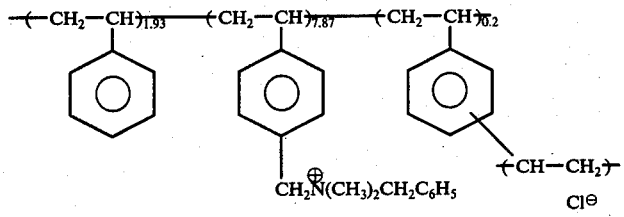 | | | | | | | | | | |
| *D = 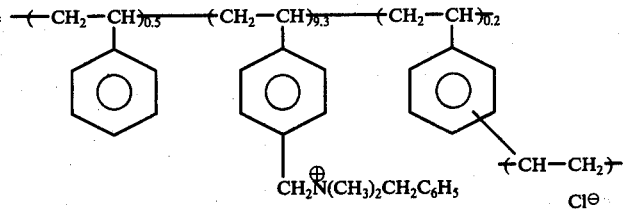 | | | | | | | | | | |
| *E = 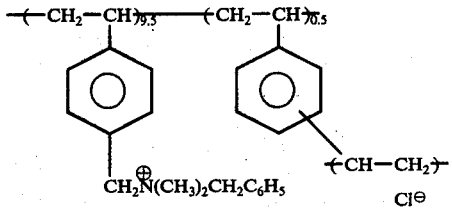 | | | | | | | | | | |
| *F = 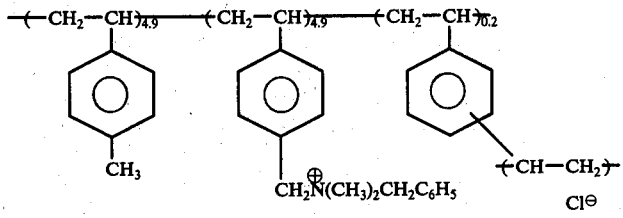 | | | | | | | | | | |
| *G = 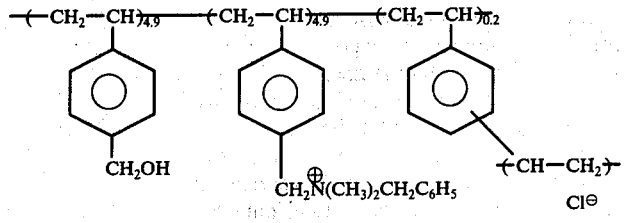 | | | | | | | | | | |

TABLE I-continued

| Example | Inhibitor Scavenger (mg/0.093m²) | Inhibitor | Molar Concentration of Inhibitor $6.4 \times 10^{-5}$ Density Loss | Speed Loss | $3.2 \times 10^{-5}$ Density Loss | Speed Loss | $1.8 \times 10^{-5}$ Density Loss | Speed Loss | $0.8 \times 10^{-5}$ Density Loss | Speed Loss |
|---|---|---|---|---|---|---|---|---|---|---|
| *H = 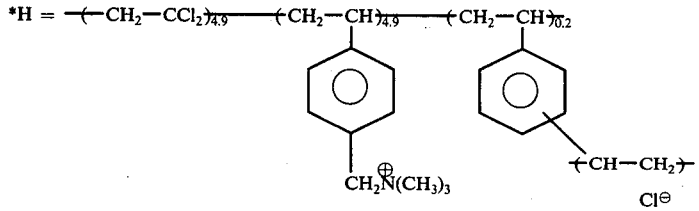 | | | | | | | | | | |
| *I = 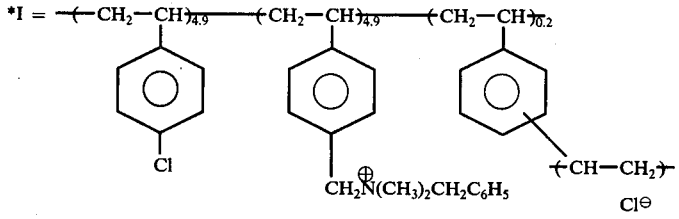 | | | | | | | | | | |
| *J = 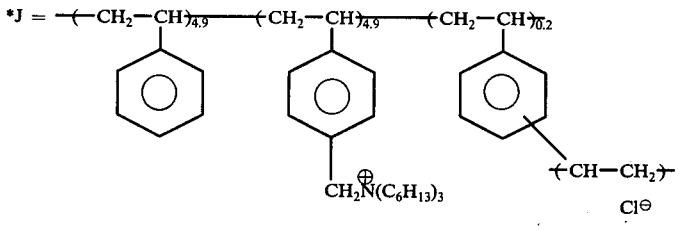 | | | | | | | | | | |
| *K = 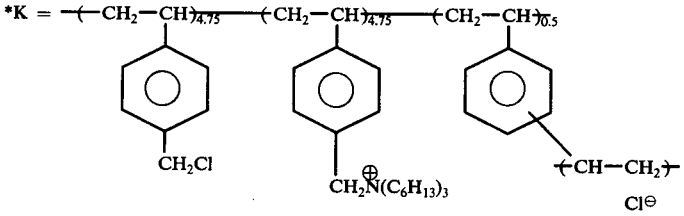 | | | | | | | | | | |

As seen above, the use of the polymeric scavengers of this invention greatly reduces the density loss and speed loss due to the migration of the inhibitor anion from the developer to the element. It is pointed out that although the silver bromide Lippmann emulsion scavengers effectively reduce the density loss and speed loss with the 1-phenyl-5-mercaptotetrazole inhibitor, the use of these Lippmann emulsion scavengers can detrimentally affect the sensitometric properties of the element.

EXAMPLE 24

Multilayer color photographic elements, with and without the presence of an inhibitor scavenger layer, were prepared. The photographic elements comprised a transparent support having coated thereon in the order recited:

1. A red-sensitized gelatino-silver bromoiodide emulsion layer (200 mgAg/0.093m²) containing a cyan-dye-forming naphtholic coupler, a magenta-colored naphtholic coupler, and a development inhibitor releasing naphtholic coupler which releases a 1-phenyl-5-mercaptotetrazole from the coupling position; each coupler dissolved in a conventional coupler solvent and dispersed in gelatin.

2. A layer comprising gelatin with (Example 24) and without (Control) the inhibitor scavenger of Example 1.

3. A green-sensitized gelatino-silver bromoiodide emulsion layer (165 mgAg/0.093m²) containing a magenta-dye-forming pyrazolone coupler, a yellow-colored pyrazolone coupler, and a development inhibitor releasing pyrazolone coupler which releases a 1-phenyl-5-mercaptotetrazole from the coupling position; each coupler dissolved in a conventional coupler solvent and dispersed in gelatin.

4. A gelatin overcoat layer.

To test for interimage effects produced in the green-sensitive layer by the inhibitor released imagewise from the development inhibitor releasing coupler contained in the red-sensitive layer, samples of each photographic element were given a red-light exposure through a graduated density test object and a uniform green-light flash, separate samples receiving variable intensities of the uniform green flash.

The exposed samples were then processed according to the procedure described in Examples 1–23.

In this manner, the development inhibitor is released as a function of development in the red-sensitive layer, i.e., imagewise, and the effect it has on the contiguous, uniformly exposed green-sensitive layer can be measured by the decrease in magenta dye-formation in areas where the inhibitor had migrated. Therefore, the less the density change ($\Delta D_G$), the less the interimage effect.

The results were recorded as sensitometric curves plotted on density vs. exposure (red-light) graphs. The following numerical data has been tabulated from the magenta dye curves of the graph:

TABLE 2

| Green Flash | Density to Green Light (Control) Area A | Area B | $\Delta D_G$ | Example 24 Area A | Area B | $\Delta D_G$ |
|---|---|---|---|---|---|---|
| Highest Intensity | 2.10 | 1.52 | .58 | 2.03 | 1.76 | .27 |
| Medium Intensity | 1.46 | 1.03 | .43 | 1.40 | 1.18 | .22 |
| Lowest Intensity | 0.96 | 0.65 | .31 | 0.93 | 0.74 | .19 |

In the above tests, Area A represents the area of the samples in which the red-sensitive layer received substantially no exposure and development, i.e. $D_{min}$ area. Therefore, in this area no inhibitor was released from the naphtholic development inhibitor releasing coupler. Area B represents the area in which the red-sensitive layer received maximum exposure and development, hence, a maximum amount of inhibitor was released.

The density to green light represents the combined densities of (1) the magenta dye formed during color development of the green-sensitive layer, (2) the magenta-colored naphtholic coupler in the unexposed areas of the red-sensitive layer and/or (3) the unwanted green light absorption of the cyan dye formed in the exposed areas of the red-sensitive layer. Since the green light absorption of (2) and (3) above is substantially constant in all photographic samples, the differences in $\Delta D_G$ is solely representative of the degree of color development and dye formation in the green-sensitive layer. The decrease in $\Delta D_G$ in the photographic elements containing the inhibitor barrier layer is indicative of less development inhibition, and demonstrates that the layer of Example 24 was effective in preventing the migration of inhibitor from the red-sensitive layer.

In the control, layer 2 consists of gelatin (350 mg/0.093m²) and in Example 24 layer 2 consists of gelatin (240 mg/0.093m²) and the inhibitor scavenger of Example 1 (150 mg/0.093m²).

The invention has been described in detail with particular reference to preferred embodiments thereof, but it will be understood that variations and modifications can be effected within the spirit and scope of the invention.

What is claimed is:

1. A photographic element comprising a support having at least one layer containing a silver halide emulsion and at least one layer containing a development inhibitor scavenger, and wherein no acid dye or acid dye precursor is present, the improvement wherein said development inhibitor scavenger is a crosslinked polymer comprising units represented by the formula:

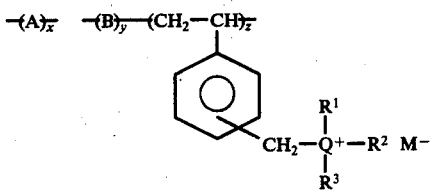

wherein

A is a polymerized monomer containing at least two ethylenically unsaturated groups;

B is a polymerized copolymerizable $\alpha$, $\beta$-ethylenically unsaturated monomer;

Q is N or P;

$R^1$, $R^2$ and $R^3$ are independently selected from the group consisting of carbocyclic, alkyl, aryl and aralkyl and wherein $R^1$, $R^2$ and $R^3$ can, together with Q, form a heterocyclic ring;

$M^-$ is an anion;

$x$ is from about 0.25 to about 5 mole percent;

$y$ is from about 0 to about 90 mole percent; and $z$ is from about 10 to about 99 mole percent.

2. The photographic element of claim 1 wherein $x$ is from 1.0 to 5.0 mole percent, $y$ is from 0 to 45 mole percent and $z$ is 40 to 99 mole percent.

3. The photographic element of claim 1 wherein Q is N.

4. The photographic element of claim 1 wherein A is a unit of divinylbenzene monomer.

5. The photographic element of claim 1 wherein $R^1$, $R^2$ and $R^3$ are each alkyl or aralkyl.

6. The photographic element of claim 1 wherein the layer containing the silver halide emulsion also contains the development inhibitor scavenger.

7. The photographic element of claim 1 wherein at least one layer contains a development inhibitor anion or development inhibitor release agent.

8. The photographic element of claim 1 wherein the polymer comprises units represented by the formula

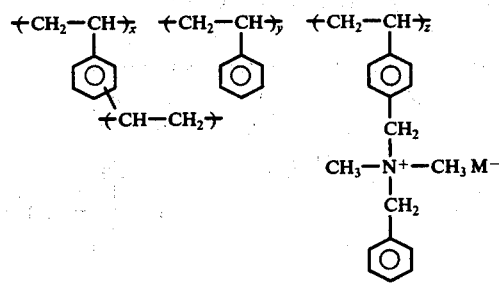

wherein $M^-$ is an anion;

$x$ is from about 0.25 to about 5.0 mole percent;

$y$ is from about 0 to about 90 mole percent; and $z$ is from about 10 to about 99 mole percent.

9. A process for forming a visible photographic image comprising developing an exposed photographic element wherein no acid dye or acid dye precursor is present, said element comprising a support and a photogtaphic silver halide emulsion layer and integral with said photographic element, a development inhibitor scavenger comprising a crosslinked polymer comprising units represented by the formula:

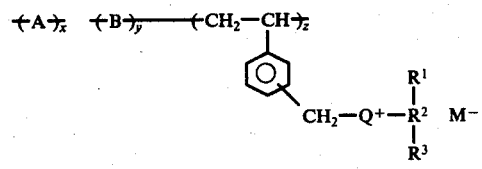

wherein

A is a polymerized monomer containing at least two ethylenically unsaturated groups;

B is a polymerized copolymerizable $\alpha$,$\beta$-ethylenically unsaturated monomer;

Q is N or P;

$R^1$, $R^2$ and $R^3$ are independently selected from the group consisting of carbocyclic, alkyl, aryl and aralkyl and wherein $R^1$, $R^2$ and $R^3$ can, together with Q, form a heterocyclic ring;

M− is an anion;
$x$ is from about 0.25 to about 5 mole percent;
$y$ is from about 0 to about 90 mole percent; and
$z$ is from about 10 to about 99 mole percent.

10. The process of claim 9 wherein the photographic element contains at least one layer containing a development inhibitor anion or development inhibitor release agent.

11. The process of claim 9 wherein the developing solution used to develop the exposed photographic element contains a development inhibitor release agent.

12. The process of claim 11 wherein said development inhibitor released is 5,6-dichlorobenzotriazole.

13. The process of claim 9 wherein $x$ is from 1.0 to 5.0 mole percent, $y$ is from 0 to 45 mole percent and $z$ is 40 to 99 mole percent.

14. The process of claim 9 wherein $x$ is from 1.0 to 5.0 mole percent, $y$ is from 0 to 45 mole percent and $z$ is 40 to 99 mole percent.

15. The process of claim 9 wherein Q is N.

16. The process of claim 9 wherein A is a unit of divinylbenzene monomer.

17. The process of claim 9 wherein the polymer comprises units represented by the formula:

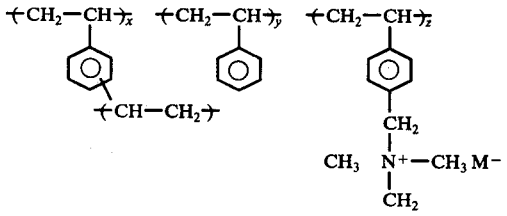

wherein
M− is an anion;
$x$ is from about 0.25 to about 5.0 mole percent;
$y$ is from about 0 to about 90 mole percent; and
$z$ is from about 10 to about 99 mole percent.

18. A multilayer color photographic element wherein no acid dye or acid dye precursor is present, said element comprising a support having thereon at least (1) a red-sensitive coupler-containing silver halide emulsion layer, (2) a green-sensitive coupler-containing emulsion layer, (3) a blue-sensitive coupler-containing layer and (4) a layer containing a crosslinked polymer which comprises units represented by the formula

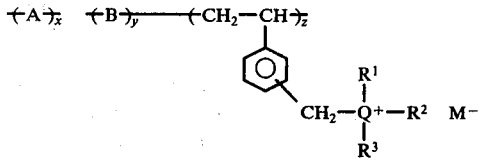

wherein
A is a polymerized monomer containing at least two ethylenically unsaturated groups;
B is a polymerized copolymerizable $\alpha,\beta$-ethylenically unsaturated monomer;
Q is N or P;
$R^1$, $R^2$ and $R^3$ are independently selected from the group consisting of carbocyclic, alkyl, aryl and aralkyl and wherein $R^1$, $R^2$ and $R^3$ can, together with Q, form a heterocyclic ring;
M is an anion;
$x$ is from about 0.25 to about 5 mole percent;
$y$ is from about 0 to about 90 mole percent; and
$z$ is from about 10 to about 99 mole percent.

19. The element of claim 18 wherein at least one layer contains a development inhibitor anion or development inhibitor release agent.

* * * * *